US009581316B2

(12) United States Patent
Karchon et al.

(10) Patent No.: US 9,581,316 B2
(45) Date of Patent: Feb. 28, 2017

(54) APPARATUS AND METHOD FOR ENCAPSULATING TRITIUM

(71) Applicant: Cammenga Company, LLC, Dearborn, MI (US)

(72) Inventors: Christopher J. Karchon, Bloomfield Hills, MI (US); Alexander J. Karchon, Northville, MI (US); Robert J. Henderson, Milford, MI (US)

(73) Assignee: Cammenga Company, LLC, Dearborn, MI (US)

( * ) Notice: Subject to any disclaimer, the term of this patent is extended or adjusted under 35 U.S.C. 154(b) by 386 days.

(21) Appl. No.: 13/780,695

(22) Filed: Feb. 28, 2013

(65) Prior Publication Data

US 2014/0198485 A1 Jul. 17, 2014

Related U.S. Application Data

(60) Provisional application No. 61/752,112, filed on Jan. 14, 2013.

(51) Int. Cl.
*F21V 15/01* (2006.01)
*B26B 11/00* (2006.01)
(Continued)

(52) U.S. Cl.
CPC ..... *F21V 15/01* (2013.01); *B26B 1/10* (2013.01); *B26B 11/001* (2013.01);
(Continued)

(58) Field of Classification Search
CPC ..... B26B 11/008; B26B 11/001; B26B 1/10; F21L 26/00; F21V 15/00; F21V 15/01;
(Continued)

(56) References Cited

U.S. PATENT DOCUMENTS 3,224,978 A 12/1965 MacHutchin et al.
3,325,420 A 6/1967 Futterknecht et al.
(Continued)

FOREIGN PATENT DOCUMENTS

DE 3816489 A1 11/1989
DE 202004012237 U1 12/2005
(Continued)

OTHER PUBLICATIONS

Keychain Gadgets and Pocket Tools: TEC Accessories Glow Pellet Kit—Tritium installation with Norland 61; Jul. 24, 2011; http://keychainpockets.blogspot.com/2011/07/tec-accessories-glow-pellet-kit-tritium.html accessed Dec. 13, 2012.
(Continued)

*Primary Examiner* — Diane Lee
*Assistant Examiner* — Mitchell Errett
(74) *Attorney, Agent, or Firm* — The Dobrusin Law Firm, P.C.

(57) ABSTRACT

A module comprising: one or more vials containing tritium; one or more tritium covers; and an open space within the one or more tritium covers, wherein the one or more vials containing tritium are located within the open space of the one or more tritium covers so that the one or more tritium covers protect the one or more vials containing tritium, and wherein the one or more tritium covers are made from a material that exhibits sufficient strength so that the module protects the one or more vials containing tritium from damage when dropped from a distance of 1 m or more.

16 Claims, 4 Drawing Sheets

(51) Int. Cl.

| | |
|---|---|
| ***G21H 3/02*** | (2006.01) |
| ***H01J 65/08*** | (2006.01) |
| ***B26B 1/10*** | (2006.01) |
| ***G21F 1/10*** | (2006.01) |
| ***G21F 5/015*** | (2006.01) |
| ***G21F 5/08*** | (2006.01) |
| *F21V 15/00* | (2015.01) |
| *F21L 26/00* | (2006.01) |

(52) U.S. Cl.
CPC ..... *B26B 11/008* (2013.01); *G21F 1/10* (2013.01); *G21F 5/015* (2013.01); *G21F 5/08* (2013.01); *G21H 3/02* (2013.01); *H01J 65/08* (2013.01); *F21L 26/00* (2013.01); *F21V 15/00* (2013.01)

(58) Field of Classification Search
CPC .... G21F 5/08; G21F 5/015; G21F 1/10; H61J 65/08; G21H 3/02
USPC ..... 362/84, 119, 249.01; 264/0.5
See application file for complete search history.

(56) References Cited

U.S. PATENT DOCUMENTS

| | | | | |
|---|---|---|---|---|
| 3,368,287 | A | 2/1968 | Ault | |
| 3,478,209 | A | 11/1969 | Feuer | |
| 4,342,071 | A * | 7/1982 | Chamberlain | 362/158 |
| 4,741,120 | A | 5/1988 | Cota et al. | |
| 4,788,437 | A | 11/1988 | Urquhart et al. | |
| 4,926,435 | A | 5/1990 | Kazan | |
| 4,928,414 | A | 5/1990 | Bright | |
| 4,947,475 | A | 8/1990 | Bright | |
| 4,990,804 | A | 2/1991 | McNair | |
| 5,065,519 | A | 11/1991 | Bindon | |
| 5,124,610 | A | 6/1992 | Conley et al. | |
| 5,359,800 | A | 11/1994 | Fisher et al. | |
| 5,502,895 | A | 4/1996 | Lemaire | |
| 5,671,997 | A | 9/1997 | Potts | |
| 5,727,319 | A | 3/1998 | Myerchin et al. | |
| 5,899,009 | A | 5/1999 | Fisher | |
| 6,074,078 | A * | 6/2000 | Georgeff et al. | 362/503 |
| 6,216,351 | B1 | 4/2001 | Flubacher et al. | |
| 6,257,734 | B1 * | 7/2001 | Tchira | 362/202 |
| 7,008,076 | B2 * | 3/2006 | Zirk et al. | 362/119 |
| 7,743,546 | B2 | 6/2010 | Keng | |
| 7,903,503 | B2 | 3/2011 | Olmes | |
| 8,104,218 | B2 | 1/2012 | McCann | |
| 8,230,637 | B2 * | 7/2012 | Lamb | 42/145 |
| 2004/0105345 | A1 | 6/2004 | Kouch | |
| 2005/0005656 | A1 | 1/2005 | Seebock | |
| 2006/0049365 | A1 * | 3/2006 | Hickey | 250/462.1 |
| 2008/0186571 | A1 | 8/2008 | Wagner et al. | |
| 2009/0013581 | A1 * | 1/2009 | LoRocco | 42/132 |
| 2010/0088944 | A1 * | 4/2010 | Callihan | 42/145 |
| 2011/0289780 | A1 | 12/2011 | Tiegs | |
| 2012/0081886 | A1 | 4/2012 | Brown et al. | |
| 2013/0335951 | A1 * | 12/2013 | Faughn et al. | 362/119 |

FOREIGN PATENT DOCUMENTS

| | | | |
|---|---|---|---|
| EP | 0476845 | A1 | 3/1992 |
| WO | 2004/065511 | A2 | 8/2004 |

OTHER PUBLICATIONS

CPF MarketPlace: Neck Knife; May 3, 2011; http://www.cpfmarketplace.com/mp/showthread.php?251455-SOLD-Ams accessed Dec. 13, 2012.

Arizona Custom Knives: Tritium Folder; Jun. 6, 2008; http://www.arizonacustomknives.com/Tritium-Folder-by-Alan-Folts.aspx accessed Dec. 13, 2012.

Arizona Custom Knives: Madd Maxx 4 Tritium Proto; Oct. 13, 2010; http://www.arizonacustomknives.com/Madd-Maxx-4-Tritium-Proto-by-Darrel-Ralph.aspx accessed Dec. 13, 2012.

Arizona Custom Knives: Madd Maxx IV—Tritium DLC; Sep. 28, 2007; http://www.arizonacustomknives.com/Madd-Maxx-IV--Tritium-DLC-by-Darrel-Ralph.aspx accessed Dec. 13, 2012.

Arizona Custom Knives: 110-1T Scarab D/E; Sep. 15, 2009; http://www.arizonacustomknives.com/110-1T-Scarab-D-E--Black-Plain-Edge--Carbon-Fib-by-Microtech-Knives.aspx accessed Dec. 13, 2012.

Arizona Custom Knives: L-UDT Splash Tritium RARE; Aug. 10, 2012; http://www.arizonacustomknives.com/L-UDT-Splash-Tritium-RARE-by-Microtech.aspx accessed Dec. 13, 2012.

Arizona Custom Knives: MSC RCC NM-Strider Knives; Jun. 22, 2012; http://www.arizonacustomknives.com/MSC-RCC-NM-by-Strider-Knives-127112.aspx accessed Dec. 13, 2012.

Arizona Custom Knives: Man-O-War; May 7, 2008; http://www.arizonacustomknives.com/Man-O-War-Nuke-Edition-by-Tom-Anderson.aspx accessed Dec. 13, 2012.

The International Search Report and the Written Opinion of the International Searching Authority, Application No. PCT/US2014/010629, dated Aug. 26, 2014.

* cited by examiner

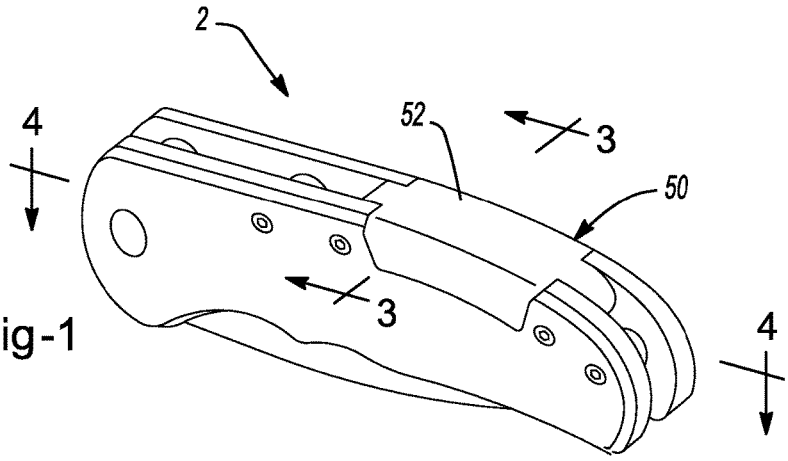
Fig-1
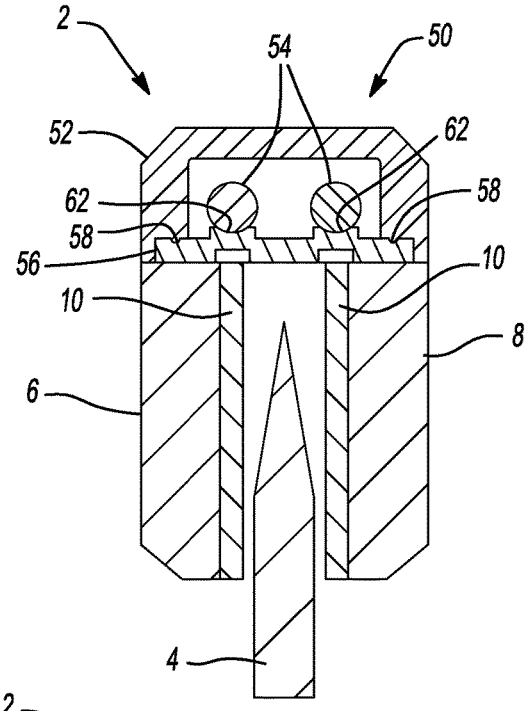
Fig-3
Fig-4
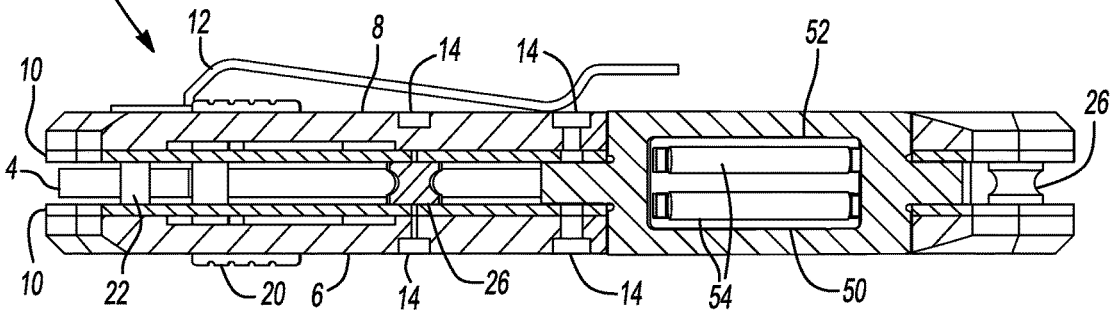

APPARATUS AND METHOD FOR ENCAPSULATING TRITIUM

CROSS REFERENCE TO RELATED APPLICATIONS

This patent application claims the benefit of U.S. Provisional Patent Application No. 61/752,112 titled "APPARATUS AND METHOD FOR ENCAPSULATING TRITIUM" filed on Jan. 14, 2013; the entire contents of which are hereby incorporated by reference herein including all attachments and other documents that were incorporated by reference in U.S. Provisional Patent Application No. 61/752,112.

FIELD

The present teachings generally relate to tritium as a luminary device and the way to encapsulate the tritium in a package that is resistant towards damage.

BACKGROUND

Typically, glass vials are filled with tritium and sealed so that the tritium is retained within the vials. These vials may be incorporated into another device so that the tritium provides illumination to the other device. When incorporated into another device the tritium vials may be damaged and broken. Further, the device may be subjected to an impact which may increase the likelihood of breaking the vials of tritium. A prototype design was produced and displayed at a trade show; however, after testing the prototype design it became apparent that the design did not adequately protect the vials of tritium from impact, thermal shock, chemicals, or water. Examples of a vial containing tritium incorporated into a device may be found in U.S. Pat. Nos. 4,741,120; 5,359,800; 6,216,351; 6,257,734; 7,743,546; and 7,903,503 and German Patent No. DE202004012237U1 all of which are expressly incorporated by reference herein for all purposes.

It would be attractive to have a module that is substantially resistant to impact so that the module prevents the vials of tritium from breaking. It would be attractive to have a module that is resistant to extreme thermal conditions and thermal shock so that the module provides protection to the vials of tritium. It would be attractive to have a module that is resistant to fluid penetration so that a fluid does not enter a cavity in the module and damage the vials of tritium. Further, it would be attractive to have a module that is resistant to the outdoor weathering conditions and ultraviolet radiation, as well as chemicals which the module incorporated into another device may be exposed to in the outdoors, for example gasoline, an insect repellent, or a sun screen.

SUMMARY

One possible embodiment of the present teachings includes: a module comprising: one or more vials containing tritium; one or more tritium covers; and an open space within the one or more tritium covers, wherein the one or more vials containing tritium are located within the open space of the one or more tritium covers so that the one or more tritium covers protect the one or more vials containing tritium, and wherein the one or more tritium covers are made from a material that exhibits sufficient strength so that the module protects the one or more vials containing tritium from breaking when dropped from a distance of 1 m or more. Preferably the module comprises two or more parts prepared from such material. Preferably, the two or more parts form a module when the two or more parts are bonded together utilizing an adhesive which forms a seal to the material of the module which forms a barrier to tritium and to materials which could impact the vials containing tritium such as water or chemicals. Preferably the tritium vials are bonded to the module with an adhesive having sufficient elasticity to reduce the risk of breakage of the vials as a result of expected impact to the module or to an article of manufacture containing the module. Preferably a sufficient amount of adhesive is utilized to reduce the risk of breakage of the vials as a result of expected impact to the module or to an article of manufacture containing the module.

Another possible embodiment of the present teachings includes: an article of manufacture comprising: one or more voids, through-holes, recesses, holes, or a combination thereof and one or more of the modules, placed in the one or more voids, through-holes, recesses, holes, or a combination thereof.

The teachings herein provide a method comprising: injection molding one or more tritium covers and injection molding one or more tritium holders, and bonding one or more tritium vials to the one or more tritium holders, and bonding the one or more tritium covers to the one or more tritium holders.

The present teachings provide a module that is substantially resistant to impact so that the module prevents the vials containing tritium from breaking. The present teachings provide a module that is resistant to extreme thermal conditions and thermal shock so that the module provides protection to the vials containing tritium. The present teachings provide a module that is resistant to fluid penetration so that a fluid does not enter the one or more voids, through-holes, recesses, holes, or a combination thereof in the module and damage the vials containing tritium. The present teachings provide a module that is resistant to the outdoor weathering conditions and ultra-violet radiation, as well as chemicals which the module incorporated into another device may be exposed to in the outdoors, for example gasoline, an insect repellent, or a sun screen.

BRIEF DESCRIPTION OF THE DRAWINGS

FIG. 1 illustrates one example of an article of manufacture including a module of the teachings herein;

FIG. 3 shows a cross-sectional view of the article of manufacture including the module illustrated in FIG. 1 along line 3-3;

FIG. 4 shows a cross-sectional view of the article of manufacture including the module illustrated in FIG. 1 along line 4-4;

DETAILED DESCRIPTION

Figure 2:
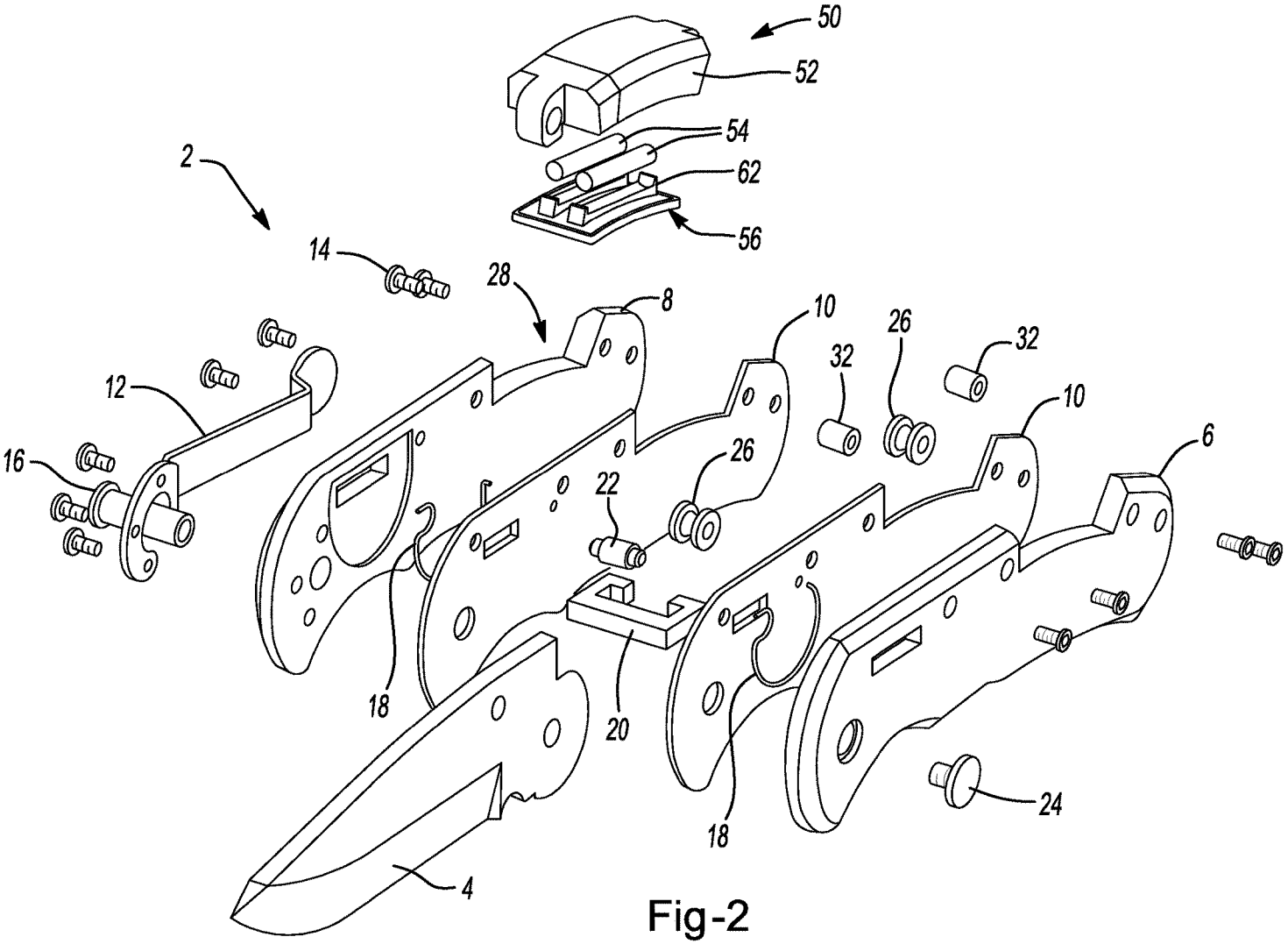
FIG. 2 shows an exploded view of the article of manufacture illustrated in FIG. 1.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings provide a module for housing vials containing tritium so that the module and vials containing tritium may be inserted into an article of manufacture. The article of manufacture may be any article that may be used at night or in low light conditions. The article of manufacture may be any article that may require some orientation so that the article may be used at night or in low light conditions. The article of manufacture may be any article that may be used for non-verbal signaling between individuals at night or in low light conditions. The article of manufacture may be any article that includes a handle. The article of manufacture may include one or more gripping portions that may be oriented for use. The article of manufacture may include one or more voids, recesses, through holes, or a combination thereof. The article of manufacture may be a knife, a tool, a flashlight, a utensil, a shovel, a screwdriver, a hammer, an axe, a gripping portion of a tool, a firearm accessory, a bow or an arrow, a sign, the like, or a combination thereof. Preferably, the article of manufacture is a fixed knife, a folding knife, or both.

The fixed knife, the folding knife, or both may be any size, shape, configuration, or a combination thereof. The fixed knife, the folding knife, or both may include a front handle, a back handle, or both. The front handle, the back handle or both may be any size, shape, configuration, or a combination thereof so that when combined, the front handle, the back handle, or both form a gripping portion. Preferably, the front handle, the back handle, or both have an ergonomic shape. The front handle, the back handle, or both may include an opening which may serve for attaching of the fixed knife, the folding knife, or both to another object. The opening may be any size, shape, configuration, or a combination thereof so that the opening may be used to secure one or more other objects to the front handle, the back handle, or both. The fixed knife, the folding knife, or both may include any feature commonly utilized on or with a knife; for example a clip-folding knife mounting. The clip folding knife mounting may be attached to the front handle, the back handle, or both with a fastener. The fastener may be any fastener that may form a removable connection, a fixed connection, or both. The fastener may be an adhesive, a mechanical fastener, a screw, a bolt, a nut, a rivet, a nail, a mechanical interlock, the like, or a combination thereof. The front handle, the back handle or both may be made of a material that is highly durable such that it will last for at least the expected luminous life of the knife which is directly influenced by the half-life of tritium, which is 12.3 years. The material of the handle may be any material commonly utilized in knife handles, such as wood, bone, metal, plastic, or the like. The material of the handle may be a polyamide resin. Preferably, the material is DuPont™ Zytel® 101 NC010.

The folding knife may have a blade which may be shorter than the length of the front handle, the back handle, or both so that the blade may be folded and be secured partially and/or fully within and/or between the front handle, the back handle, or both. The fixed knife may include a blade which extends less than the whole length or the whole length of the front handle, the back handle, or both. The folding knife, the fixed knife, or both may include a blade that may be any size, shape, configuration, or a combination thereof so that the blade may be useful for cutting, chopping, stabbing, or a combination thereof. The knife blade may have a sharp point. The blade may be attached to the front handle, the back handle, inside plates, or any combination thereof with a fastener. Preferably one or more fasteners hold the knife blade and the front handle and the back handle together. The fastener may be any fastener that may form a removable connection, a fixed connection, or both. The fastener may be a custom-shaped fastener to prevent the likelihood of a user deliberately disassembling the knife and accessing the vials containing tritium. The fastener may be an adhesive, a mechanical fastener, a screw, a bolt, a nut, a rivet, a nail, a mechanical interlock, the like, or a combination thereof. Preferably, the fastener is a custom fastener and the faster is adhered so that the fastener is securely contained within the knife. The folding knife may have a blade stop pin which may secure the folding knife blade in a secured unfolded position. The folding knife may include a blade release spring, a blade release pull, or both which may release the folding knife blade from the secured unfolded position. The stop pin, the blade release spring, the blade release pull, or a combination thereof may be attached to the folding knife with a fastener. The fastener may be any fastener discussed herein. The fastener may be a custom-shaped fastener to prevent the likelihood of a user deliberately disassembling the knife and accessing the vials containing tritium. The knife may include voids, recesses, through-holes, or a combination thereof in the front handle, the back handle, the blade, or a combination thereof, so that a module of the teachings herein may be inserted into the knife.

The module may include one or more covers, one or more tritium covers, one or more tritium holders, one or more vials containing tritium, one or more open spaces, or a combination thereof. The one or more tritium covers may be any size, shape, configuration, or a combination thereof, so that the one or more tritium covers form: an open space, an area for one or more vials containing tritium, or both. The one or more tritium covers may have any shape so that the one or more tritium covers may be placed in an article of manufacture. The one or more tritium covers may be square, round, diamond, elliptical, spherical, geometric, non-geometric, symmetrical, asymmetrical, have one or more shoulders, have one or more planar surfaces, be contoured, be arcuate, or a combination thereof. The one or more covers, the one or more holders, or both are made of a material.

The material of the one or more covers, the one or more holders, or both may be any material that has the following properties: clear transparency even at high wall thickness, high resistance to chemicals, high impact resistance, high resistance to stress cracking, high heat deflection temperature, and low water absorption, or a combination thereof. The material may be sufficiently transparent so that the vials containing tritium may be visible in the module, substantially all of the light emitted from the tritium passes through the vials, or both. The light transmission of the material in the visible range may be about 80 percent or more, preferably about 85 percent or more, or more preferably about 90 percent or more (i.e., about 94 percent). The light transmission of the material in the visible range may be about 99 percent or less, or about 97 percent or less, or about 95 percent or less. The material may be resistant to a variety of chemical substances. Preferably, the material is resistant to polar and non-polar materials, for example hydrocarbons, mixed hydrocarbons, glycols, glycol ethers, alcohols, and the like. More preferably, the material is resistant to petrol, diesel fuel, gas, ethanol, methanol, grease, windshield fluid, lighter fluid, insect repellents, or a combination thereof.

The material may have a sufficient high impact resistance so that the module may be exposed to physical impact without fracturing; the module may be dropped without cracking, breaking, scratching, or a combination thereof; the material may protect contents located within the material; or a combination thereof. The impact resistance of the material measured at 23° C. using the Charpy impact test (ISO 179/1 eA) may be about 6 kJ/m$^2$ or more, preferably about 8 kJ/m$^2$ or more, or more preferably about 10 kJ/m$^2$ or more (i.e., 13 kJ/m$^2$). The impact resistance of the material measured at 23° C. using the Charpy impact test (ISO 179/1 eA) may be about 50 kJ/m$^2$ or less, or about 25 kJ/m$^2$ or less, or about 15 kJ/m$^2$ or less.

The material may have sufficient resistance to stress cracking so that the module may be exposed to polar and non-polar media without cracking. The flexural stress of the material in polar media and non-polar media, measured according to the bent strip method ISO 4599, DIN 53449, may be about 10 MPa or more, preferably about 20 MPa or more, or more preferably about 30 MPa or more. The flexural stress of the material in polar media and non-polar media, measured according to the bent strip method ISO 4599, DIN 53449, may be about 100 MPa or less, or about 80 MPa or less, or about 60 MPa or less.

The material may be sufficiently heat resistant so that the module may be exposed to a variety of temperatures without melting, thermal cracking, softening, or a combination thereof. The material may have heat deflection in the range of about −10° C. and about 52° C. or more, preferably in the range of about −20° C. and about 62° C. or more, or more preferably in the range of about −30° C. and about 72° C. or more (i.e., from about −40° C. to about 82° C.). The material may have heat deflection in the range of about −150° C. and about 152° C. or less, or about −100° C. and about 122° C. or less, or about −80° C. and about 102° C.

The material may have sufficiently low water absorption so that the vials containing tritium within the module may be protected from contact with water, the material may not absorb water, water may not penetrate through the material, or a combination thereof. The material, when measured at the temperature of 23° C. and 100% relative humidity, may reach saturation point at about 4.5% or less, preferably at about 4.0% or less, or more preferably at about 3.5% or less (i.e., 3.0%). The material, when measured at the temperature of 23° C. and 100% relative humidity, may reach saturation point at about 0.5% or more, or at 1.5% or more, or at 2.5%.

The material may further have the following properties: high Shore D hardness, low weight due to low density, high ultra-violet resistance and high weather resistance, good dimensional stability and dynamic loading capacity, good bonding to adhesives, easy processing, or a combination thereof. The material may be any material that is resistant to thermal shock, cracking, breaking, dropping, chemicals, or a combination thereof.

The material may be sufficiently hard so that the module may withstand a puncture test, as described below, without breaking. The Shore D hardness of the material, measured according to ISSO 868, may be about 70 or more, preferably about 75 or more, or more preferably about 80 or more (i.e., 82). The Shore D hardness of the material, measured according to ISSO 868, may be about 100 or less, about 95 or less, or about 90 or less.

The material may have sufficiently low density so that the module may be light-weight with high durability. The density of the material may be about 2.5 g/cm$^3$ or less, preferably about 2.0 g/cm$^3$ or less, or more preferably about 1.5 g/cm$^3$ or less (i.e., 1.0 g/cm$^3$). The density of the material may be about 0.25 g/cm$^3$ or more, or about 0.5 g/cm$^3$ or more, or about 0.75 g/cm$^3$ or more.

The material may be sufficiently resistant so that the module's mechanical and optical properties may remain unaltered even after a prolonged exposure to ultra-violet radiation and weather conditions. After an accelerated weathering test in accordance with ISO 4892-2, no noticeable change may be observed in the mechanical and optical properties of the material after about 1,000 hours of accelerated weathering or more, more preferably after about 10,000 hours of accelerated weathering or more, or more preferably after about 15,000 hours of accelerated weathering or more (i.e., 20,000 hours of accelerated weathering). After an accelerated weathering test in accordance with ISO 4892-2, no noticeable change may be observed in the mechanical and optical properties of the material after about 100,000 hours of accelerated weathering or less, preferably after about 50,000 hours of accelerated weathering or less, or more preferably after about 30,000 hours of accelerated weathering or less.

The material may have good dynamic loading capacity so that the module may remain free of cracking. The fatigue strength of the material measured by a flexural fatigue test in accordance with DIN 53442:1990 at 23° C. may be about 10 MPa or more, preferably about 20 MPa or more, or more preferably about 30 MPa or more, (i.e., 32 MPa). The fatigue strength of the material measured by a flexural fatigue test in accordance with DIN 53442:1990 at 23° C. may be about 60 MPa or less, or about 50 MPa or less, or about 40 MPa or less.

The material may bond easily to a variety of adhesives. Examples of adhesives that may be used to bond with the module are silicon based adhesives, cyanacrylate adhesives, methacrylate adhesives, polyurethane adhesives, epoxy resin adhesives, or mixtures thereof. More preferably, the material may bond easily to adhesives comprising a dialkyl siloxane having terminal groups capable of silanol condensation, for example alkoxy and hydroxyl groups. Even more preferably, the material may easily bond to adhesives comprising one or more adhesion agents such as hydroxyl-terminated dimethyl siloxane, ethyltriacetoxysilane, methyltriacetoxysilane, amorphous silica (i.e., adhesive Dow Corning® 732 Multi-purpose Sealant clear).

The material may be easily processed so that the one or more covers, the one or more holders, or both may be formed using a variety of processes such as injection molding, injection stretch-blow molding, or extrusion. The material may be a polymer, a thermoplastic, a polyamide, a nylon, nylon 12, or a combination thereof. Preferably, the material is Grilamid® TR-90 UV Clear Nylon. The material may contain standard additives utilized in thermoplastic materials exposed to the elements, such as heat stabilizers, ultraviolet light stabilizers, antioxidants, fillers, reinforcing fillers, fire retardants, hardeners, cross-linking agents, the like, or a combination thereof.

The one or more tritium holders may be any size, shape, configuration, or a combination thereof, so that the one or more tritium holders form: a support and protection for one or more vials containing tritium within the one or more tritium covers, the module, or both. The one or more tritium holders may have any size, shape, configuration, or a combination thereof, so that the one or more vials containing tritium may be placed in the one or more tritium holders, on the one or more tritium holders, or both. The one or more tritium holders may square, round, diamond, elliptical, spherical, geometric, non-geometric, symmetrical, asymmetrical, have one or more shoulders, have one or more planar surfaces, be contoured, be arcuate, or a combination thereof. The one or more tritium holders may contain one or more cradles.

The one or more cradles may be any size, shape, configuration, or a combination thereof, so that the one or more vials containing tritium may rest in the one or more cradles, on the one or more cradles, or both. The one or more tritium cradles may be square, round, diamond, elliptical, spherical, geometric, non-geometric, symmetrical, asymmetrical, have one or more shoulders, have one or more planar surfaces, be contoured, be arcuate, or a combination thereof. Preferably, the shape of the one or more cradles substantially mirrors the shape of the vials containing tritium. For example, if the vials containing tritium are square-shaped, then the one or more cradles will form a square opening so that the vials are fitting within the one or more cradles.

The one or more modules form one or more open spaces. The one or more open spaces may be any size, shape, configuration, or a combination thereof so that the open space may contain one or more vials containing tritium. Preferably, the one or more open spaces are sufficiently large to accommodate at least two vials containing tritium. The one or more open spaces may be sufficiently large to accommodate at least one vial containing about 25 mCi or more, about 50 mCi or more, preferably about 75 mCi or more, more preferably about 100 mCi or more, or even more preferably about 500 mCi or more of tritium. The one or more open spaces may be sufficiently large to accommodate at least one vial containing about 5,000 mCi or less, about 2,500 mCi or less, about 1,750 mCi or less, about 1,000 mCi or less, 750 mCi or less, or 600 mCi or less of tritium. Preferably, the open space is large enough to accommodate two 100 mCi vials of tritium. The one or more vials containing tritium may be any size, shape, configuration, or a combination thereof so that the one or more vials containing tritium may be housed within the one or more open spaces within the module, within the one or more tritium holders, or both. The one or more vials containing tritium may be any size, length, width, thickness, shape, configuration, or a combination thereof so that the one or more vials containing tritium may be housed on the one or more cradles, in the one or more cradles, within the open space within the module, or a combination thereof within the one or more tritium holders. The one or more vials containing tritium may be shaped like a cylinder, a rectangular prism, a cube, a triangular prism, a hexagonal prism, a pyramid, a cone, a sphere, or a combination thereof. A cross-section of the one or more vials containing tritium may be square, round, diamond, elliptical, geometric, non-geometric, symmetrical, asymmetrical, or a combination thereof. Preferably, the one or more vials containing tritium are cylindrical or rectangular prisms. The inside surface of the vials may be coated with a phosphorescent material. The one or more vials containing tritium may have a variety of volumes. The volumes of the vials may be sufficiently large to contain the amount of tritium recited herein. The one or more vials may be made of a material which prevents emission of radiation. Preferably, the material of the vials containing tritium may be a material that may be bonded to the material the one or more tritium covers, the one or more tritium holders, or both are made of so that the vials may be bonded to and/or within the module. Preferably, the material is glass, and tritium may be laser-sealed into the glass vials. Preferably, the vials containing tritium are Mb-Microtec vials, Cammenga Model Number 6700.

The one or more tritium holders may be affixed to the one or more tritium covers by any method that attaches the one or more cradles to the one or more tritium covers in a manner such that the one or more vials containing tritium are secured into and sealed in the module. The one or more tritium holders may be bonded to the one or more tritium covers using any known means of bonding such polymeric parts together which facilitates the module performing its desired function, for example by a bonding material. The one or more tritium holders, the one or more tritium covers, or both may have a surface which may be treated to increase the surface area and improve bonding between the one or more tritium holders, the one or more tritium covers, or both, for example with a primer or corona treatment. The surface of the one or more tritium holders may include one or more grooves to improve bonding between the one or more tritium holders and the one or more tritium covers. The one or more grooves may be any size, shape, configuration, or a combination thereof.

The one or more vials containing tritium may be affixed to the one or more cradles, the one or more tritium holders, the one or more tritium covers by any method that attaches the one or more vials containing tritium to the one or more cradles, the one or more tritium holders, the one or more tritium covers, or a combination thereof in a manner such that the one or more vials containing tritium are secured into and sealed in the module. A surface of the one or more vials containing tritium, the one or more tritium covers, the one or more tritium holders, or the one or more cradles may be pretreated with a primer or corona treatment to improve bonding between the one or more vials containing tritium, the one or more cradles, the one or more tritium holders, the one or more tritium covers, or a combination thereof. The one or more vials containing tritium may be bonded to the one or more tritium cradles, the one or more tritium covers, the one or more tritium holders, or a combination thereof with a bonding material.

The bonding material may be any material that has the following properties: clear transparency, high Shore A hardness, good stability and flexibility in a variety of temperatures, good tensile strength, high elongation at break, or a combination thereof.

The bonding material may be sufficiently transparent so that the vials containing tritium may be visible in the module, substantially all of the light emitted from the tritium passes through the vials, or both. The light transmission of the bonding material in the visible range may be about 60 percent or more, preferably about 70 percent or more, or more preferably 80 percent or more. The light transmission of the bonding material in the visible range may be about 99 percent or less or 95 percent or less, or 90 percent or less.

The bonding material may be sufficiently hard so that the module may withstand physical impact without breaking.

The Shore A hardness of the bonding material may be about 10 or more, preferably about 15 or more, or more preferably about 20 or more (i.e., 25). The Shore A hardness of the material may be about 50 or less, about 40 or less, or about 30 or less.

The bonding material may be sufficiently heat resistant so that the module may be exposed to a variety of temperatures without melting, thermal cracking, softening, or a combination thereof. The bonding material may be stable and flexible in the range of about −30° C. and about 100° C. or more, preferably in the range of about −40° C. and about 120° C. or more, or more preferably in the range of about −50° C. and about 150° C. or more (i.e. −65° C. and 177° C.). The bonding material may be stable and flexible in the range of about −150° C. and about 250° C. or less, or in the range or about −100° C. and about 200° C. or less, or in the range of about −80° C. and about 180° C. or less.

The bonding material may be sufficiently strong so that the bonding material does not fail to bond the one or more tritium holders to the one or more tritium covers or the one or more vials containing tritium to the one or more cradles, the one or more tritium holders, the one or more tritium covers, or a combination thereof. The maximum stress the bonding material can withstand while being stretched and pulled before breaking may be about 0.75 MPa or more, preferably about 1.00 MPa or more, or more preferably about 1.25 MPa or more (i.e., 2.2 MPa). The maximum stress the bonding material can withstand while being stretched and pulled before breaking may be about 10.0 MPa or less, or about 8.0 MPa or less, or about 5.0 MPa or less.

The bonding material may have a sufficient elongation at break so that the bonding material does not fail to bond the one or more tritium holders to the one or more tritium covers or the one or more vials containing tritium to the one or more cradles, the one or more tritium holders, the one or more tritium covers, or a combination thereof. The percentage increase that occurs before the bonding material breaks under tension may be about 100 percent or more, preferably about 200 percent or more, or more preferably about 300 percent or more (i.e., 550 percent). The percentage increase that occurs before the bonding material breaks under tension may be about 1000 percent or less, or about 800 percent or less, or about 600 percent or less.

The bonding material may further have the following properties: low weight due to low density, good bonding to the material which the one or more tritium covers, the one or more tritium holders, or both are made of, easy application, or a combination thereof.

The bonding material may be sufficiently light-weight so that the module may be light-weight with high durability. The density of the bonding material may be about 2.5 g/cm$^3$ or less, preferably about 2.0 g/cm$^3$ or less, or more preferably about 1.5 g/cm$^3$ or less (i.e., 1.04 g/cm$^3$). The density of the bonding material may be about 2.5 g/cm$^3$ or less, about 0.25 g/cm$^3$ or more, or about 0.5 g/cm$^3$ or more, or about 1.0 g/cm$^3$ or more.

The bonding material has good bonding properties so that the bond between the one or more vials containing tritium, one or more cradles, one or more tritium covers, one or more tritium holders, or a combination thereof is strong enough to hold the module together and protect the vials containing tritium from penetration by liquids, cracking, breaking, or a combination thereof. The bonding material may bind to polymers, more preferably to thermoplastics, even more preferably to polyamide (i.e. Grilamid® TR-90 UV Clean Nylon).

The bonding material may be easily applied so that the module can be easily assembled. The bonding material may become tack-free after application in about 45 minutes or less, preferably about 35 minutes or less, more preferably in about 25 minutes or less (i.e., 15 minutes). The bonding material may become tack-free after application in about 5 minutes or more, about 10 minutes or more, or about 12 minutes or more.

The bonding material may be any material that is resistant to thermal shock, cracking, breaking, dropping, chemicals, or a combination thereof. The bonding material may be resistant to a variety of chemical substances. Preferably, the bonding material is resistant to polar and non-polar materials, for example hydrocarbons, mixed hydrocarbons, glycols, glycol ethers, alcohols, and the like. More preferably, the bonding material is resistant to petrol, diesel fuel, gas, ethanol, methanol, grease, windshield fluid, lighter fluid, insect repellents, or a combination thereof. The bonding material may be a polymer, an elastomer, or both. Preferably the bonding material is an adhesive, more preferably a silicon based adhesive, even more preferably the adhesive comprises a dialkyl siloxane having terminal groups capable of silanol condensation, for example alkoxy and hydroxyl groups. Preferably the adhesive comprises one or more adhesion agents such as hydroxyl-terminated dimethyl siloxane, ethyltriacetoxysilane, methyltriacetoxysilane, amorphous silica. Adhesives that can be applied using standard means such as extrusion are preferred. The bonding material preferably may form a bead which is capable of cushioning the tritium vials during expected shock to the module or device containing the module. Most preferably, the bonding material is Dow Corning® 732 Multi-purpose Sealant clear for bonding the one or more tritium holders to the one or more tritium covers. Most preferably, the bonding material is Dow Corning® 734 Flowable Sealant clear for bonding the one or more vials containing tritium to the one or more cradles, the one or more tritium holders, the one or more tritium covers, or a combination thereof.

The material for the one or more tritium covers, the one or more tritium holders, or both, and the bonding material may be any material that successfully passes one or more and preferably all of the following tests: an impact test, a thermal shock test, a puncture test, a diffusion test, a contamination test, or a combination thereof. The material for the one or more tritium covers, the one or more tritium holders, or both, and the bonding material may be sufficiently strong so that the module may withstand an impact test. The impact test is performed by repeatedly dropping an article of manufacture including a module containing vials containing tritium from a certain height onto steel and concrete surfaces. The module is examined visually for damage. The module must have no visual cracking, damage, or both. For example, a module including two vials containing tritium that each contain 100 mCi of tritium, is connected to a folding knife weighing 0.5 Kg. The knife is raised to a height of 1 m above a stainless steel plate. The knife is oriented so that the module is facing the stainless steel plate, and the knife is dropped. The module and the vials containing tritium are inspected for damage, and the process is repeated 9 more times. Upon visual inspection after each drop, no visual cracking, damage, or both should be apparent, and the vials containing tritium remain intact. The knife is then raised to a height of 1 m above concrete surface. The knife is oriented so that the module is facing the concrete, and the knife is dropped. The module and the vials containing tritium are inspected for damage, and the process is repeated 9 more times. Upon visual inspection after each drop, no visual cracking, damage, or both should be apparent, and the vials containing tritium remain intact. This procedure may be repeated at heights of about 2 m or more, about 3 m or more, or even 4 m.

The material for the one or more tritium covers, the one or more tritium holders, or both, and the bonding material may have sufficient glass transition temperature so that the module may withstand a thermal shock test. The thermal shock test is performed by repeatedly exposing an article of manufacture including a module containing vials containing tritium to low temperature for certain period of time, removing the article of manufacture from the cold environment and immediately exposing the article of manufacture to high temperature for certain period of time. The process is repeated once more. The module is then visually examined for damage. The module must have no visual cracking, damage, or both. For example, a module including two vials containing tritium that each contain 100 mCi of tritium, is connected to a folding knife weighing 0.5 Kg. The knife is placed in an environment of −52° C. for 15 minutes. The knife is then removed from the cold environment and immediately placed into temperature of 68° C. for 15 minutes. The knife is then placed in the environment of −52° C. for another 15 minutes. The knife is then removed from the cold environment and immediately placed into temperature of 68° C. for 15 minutes. The knife is then placed into an environment with room temperature, and the module and the vials containing tritium are inspected for damage. Upon visual inspection, no visual cracking, damage, or both should be apparent, and the vials containing tritium remain intact.

The material may be sufficiently hard so that the module may withstand a puncture test without breaking. The puncture test is performed by repeatedly hitting an article of manufacture including a module containing vials containing tritium with a small hammer or a similar object 10 times. The process is repeated with another object 10 times. The module is examined visually for damage. The module must have no visual cracking, damage, or both. For example, a module including two vials containing tritium that each contain 100 mCi of tritium, is connected to a folding knife weighing 0.5 Kg. The knife receives a series of blows from a small peen hammer. The knife is oriented so that the module is facing the small peen hammer. The module and the vials containing tritium are inspected for damage, and the process is repeated with another object. For example, the knife receives a series of blows from a riffle barrel. The knife is oriented so that the module is facing the riffle barrel. The module and the vials containing tritium are inspected for damage, and the process is repeated with another object. For example, the knife receives a series of blows from a rock. The knife is oriented so that the module is facing the rock. The module and the vials containing tritium are inspected for damage. Upon visual inspection after each series of blows from a different object, no visual cracking, damage, or both should be apparent, and the vials containing tritium remain intact.

The material for the one or more tritium covers, the one or more tritium holders, or both, and the bonding material may have sufficiently low diffusion so that the module may withstand a diffusion test. The diffusion test is performed by submerging an article of manufacture including a module containing vials containing tritium into 10 ml of distilled water for a predetermined period of time. The distilled water is analyzed for its radioactive content. The radioactive content of the distilled water to pass the diffusion test will be 3,700 dpm or lower. For example, a module including two vials containing tritium that each contain 100 mCi of tritium, is connected to a folding knife weighing 0.5 Kg. The knife is submerged into 1 L of distilled water for 24 hours at 23° C. After 24 hours, the knife is removed from the distilled water, and 10 ml of the water is analyzed. The radioactive content of the 10 ml of the water does not exceed 3,700 dpm.

The material for the one or more tritium covers, the one or more tritium holders, or both, and the bonding material may have sufficient strength and sufficiently low diffusion so that the module may withstand a contamination test. The contamination test is performed by wiping all exterior surfaces of an article of manufacture including a module containing vials containing tritium with a filter paper and determining radioactive contamination of the filter paper using a scintillation machine. To pass the contamination test the radioactive contamination result will be lower than 900 dmp per article of manufacture. For example, a module including two vials containing tritium that each contain 100 mCi of tritium, is connected to a folding knife weighing 0.5 Kg. All exterior surfaces of the knife are wiped with Whatman-50 filter paper. The Whatman-50 filter paper is analyzed using a liquid scintillation machine. The result is lower than 900 dpm.

The method for encapsulating tritium may include one or more of the following steps, and the steps may be performed in virtually any order. Forming one or more tritium covers, one or more tritium holders, or both by injection blow molding, injection stretch-blow molding, extrusion, or a combination thereof. Connecting the one or more vials containing tritium to the one or more tritium covers, one or more tritium holders, or both. Preferably the vials are connected to the one or more tritium covers, one or more tritium holders, or both in a manner such that the vials containing tritium are protected from shock during normal use. The connection may be formed using an adhesive, the adhesive is applied as a bead which forms a cured bead having sufficient cross-sectional thickness so as to protect the one or more vials containing tritium from breakage during normal shock to the module or device containing the module. Preferably, the bead of adhesive exhibits a cross-sectional thickness of about 0.5 mm to about 1.0 mm. Combining the one or more tritium covers, the one or more tritium holders, or both together to form one or more modules. Allowing any adhesives used to combine the one or more tritium covers, the one or more tritium holders, the one or more vials containing tritium, the one or more cradles, or a combination thereof to cure. Treating a surface of the one or more vials containing tritium, the one or more cradles, the one or more tritium holders, the one or more tritium covers, or a combination thereof with a primer or corona treatment. Inserting the one or more vials containing tritium on the one or more cradles, in the one or more cradles, or both. Creating one or more grooves in the one or more tritium holders to improve the connection between the one or more tritium holders and the one or more tritium covers. Creating holes, through-holes, voids, or recesses in the one or more modules so that the one or more modules can be attached to an article of manufacture.

FIG. 1 illustrates one example of an article of manufacture 2 including a module 50 of the teachings herein. As illustrated, a tritium cover 52 forms a portion of the article of manufacture 2.

FIG. 2 shows an exploded view of the article of manufacture 2 illustrated in FIG. 1. The article of manufacture 2 includes a folding knife blade 4. The folding knife blade 4 is attached to two inside plates 10, a front handle 6, and a back handle 8 with an arrow screw 24, and an elongated nut 16. The back handle 8 includes a clip-folding knife mounting 12 attached to the back handle 8 with star screws 14. The article of manufacture 2 further includes a blade stop pin 22 for securing the folding knife blade 4 in fully unfolded position. The article of manufacture 2 further includes two blade release springs 18 located between the inside blades 10 and the front handle 6 and the back handle 8 respectively, and a blade release pull 20 for releasing the folding knife blade 4 from the secured fully unfolded position. The article of manufacture 2 also includes two grooved space nuts 26 located between the inside plates 10. The article of manufacture further includes a module 50 including a tritium cover 52 which is attached to a tritium holder 56 including two cradles 62 for supporting vials containing tritium 54. The module 50 placed in the void for module 28 within the article of manufacture 2 is attached to the article of manufacture with round spacer nuts 32 and star screws 14.

FIG. 3 shows a cross-sectional view of the article of manufacture 2 including the module 50 illustrated in FIG. 1 along line 3-3. The module 50 includes a tritium cover 52, a tritium holder 56, and two vials containing tritium 54 with circular cross section. The tritium holder 56 includes two cradles 62 for housing of the two vials containing tritium 54. The tritium holder 56 further contains two grooves 58 for improving attachment of the tritium holder 56 to the tritium cover 52. The module 50 is located in the top portion of the article of manufacture 2 in such a way that, when the folding knife blade 4 is fully folded, the folding knife blade 4 comes between the inside plates 10 attached to the front handle 6 and the back handle 8 respectively, but does not reach the module 50. As illustrated, the vials containing tritium 54 are visible from the top side of the article of manufacture 2, from the bottom side of the article of manufacture 2, from the side of the front handle 6, and front the side of the back handle 8.

FIG. 4 shows a cross-sectional view of the article of manufacture 2 including the module 50 illustrated in FIG. 1 along line 4-4. As illustrated, the module 50 includes a tritium cover 52 and two vials containing tritium 54. The article of manufacture 50 further includes the front handle 6, the back handle 8, and the folding knife blade which is folded between the inside plates 10. The back handle includes the clip-folding knife mounting 12. The article of manufacture 2 further includes a blade stop pin 22 for securing the folding knife blade 4 in the fully unfolded position and a blade release pull 20 for releasing the folding knife blade 4 from the secured fully unfolded position. As illustrated, the article of manufacture further includes grooved spacer nuts 26 placed between the inside plates 10 and attached to the inside plates 10, the front handle 6, and the back handle 8 with star screws 14.

Figure 5:
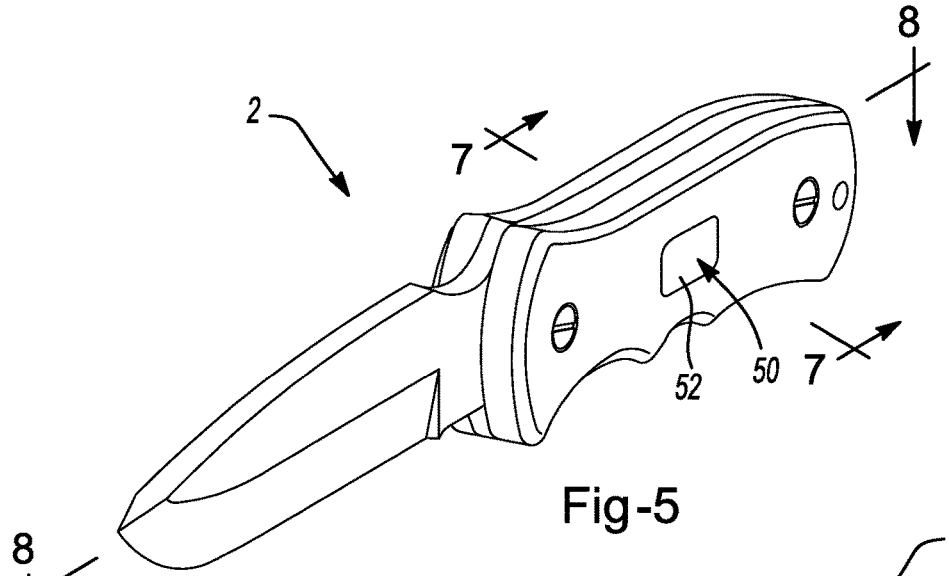
FIG. 5 illustrates another example of an article of manufacture including another example of the module of the teachings herein.

FIG. 5 illustrates another example of an article of manufacture 2 including another configuration of the module 50 of the teachings herein. As illustrated, a tritium cover 52 forms a portion of the article of manufacture 2.

Figure 6:
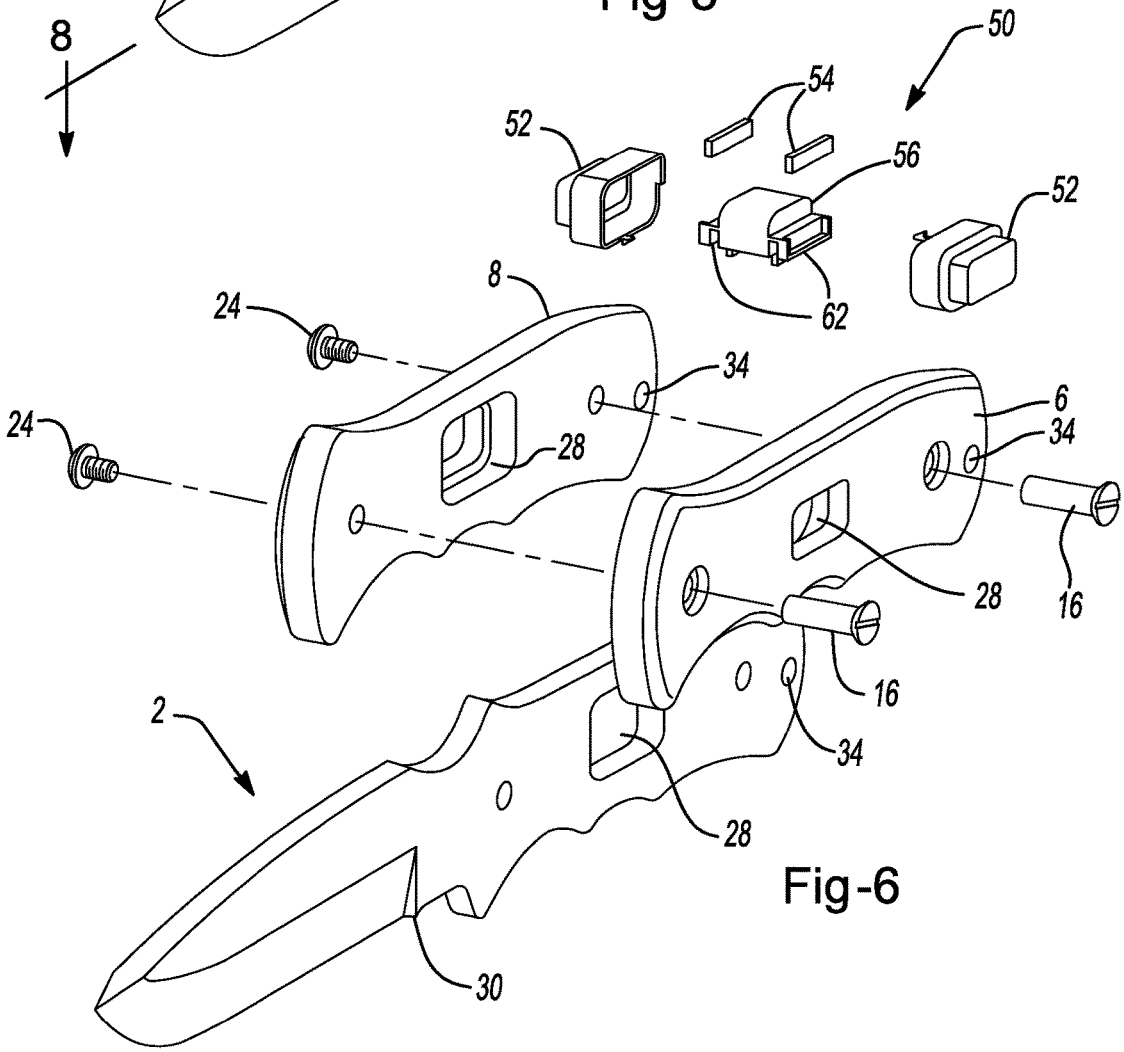
FIG. 6 shows an exploded view of the article of manufacture illustrated in FIG. 5.

FIG. 6 shows an exploded view of the article of manufacture 2 illustrated in FIG. 5. The article of manufacture 2 includes a fixed knife blade 30 which is secured to a front handle 6 on one side and a back handle 8 on the other side with arrow screws 24 and elongated nuts 16. The article of manufacture 2 further includes a module 50 including two tritium covers 52, a tritium holder 56 including two cradles 62 for supporting the vials containing tritium 54. As illustrated, the void for module 28 for accommodating the module 50 extends through the front handle 4, the fixed knife blade 30, and the back handle 8. The article of manufacture further includes an opening 34 extending through the front handle 4, the fixed knife blade 30, and the back handle 8, for attaching of the article of manufacture 2 to another object.

Figure 7:
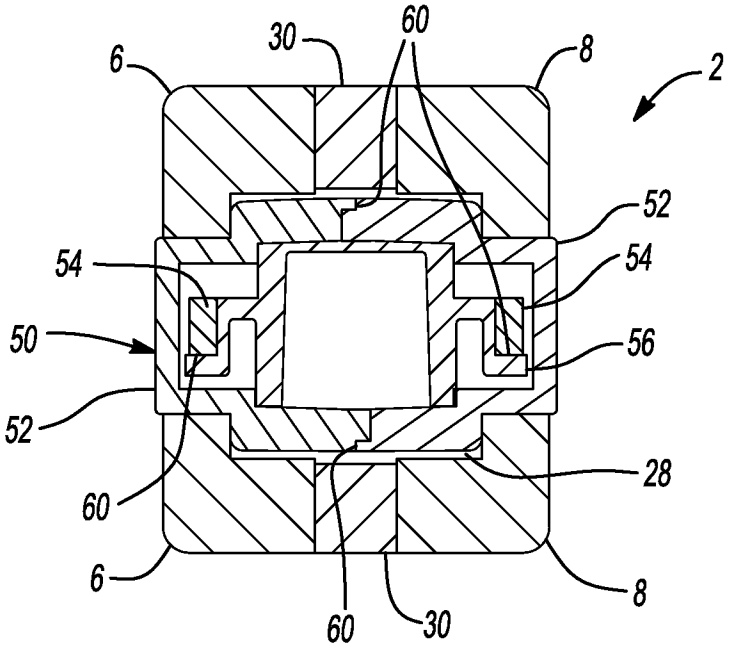
FIG. 7 shows a cross-sectional view of the module incorporated into the article of manufacture illustrated in FIG. 5 along line 7-7.

FIG. 7 shows a cross-sectional view of the module incorporated into the article of manufacture illustrated in FIG. 5 along line 7-7. As illustrated, the module 50 is incorporated into the void for module 28 extending through the front handle 6, the fixed knife blade 30, and the back handle 8 of the article of manufacture 2. The module 50 includes two tritium covers 52, two vials containing tritium 54, and a tritium holder 56. The two vials containing tritium 54 are attached to the tritium holder 56 with seal/adhesive beads 60, and the two tritium covers 52 are bonded together with seal/adhesive beads 60.

Figure 8:
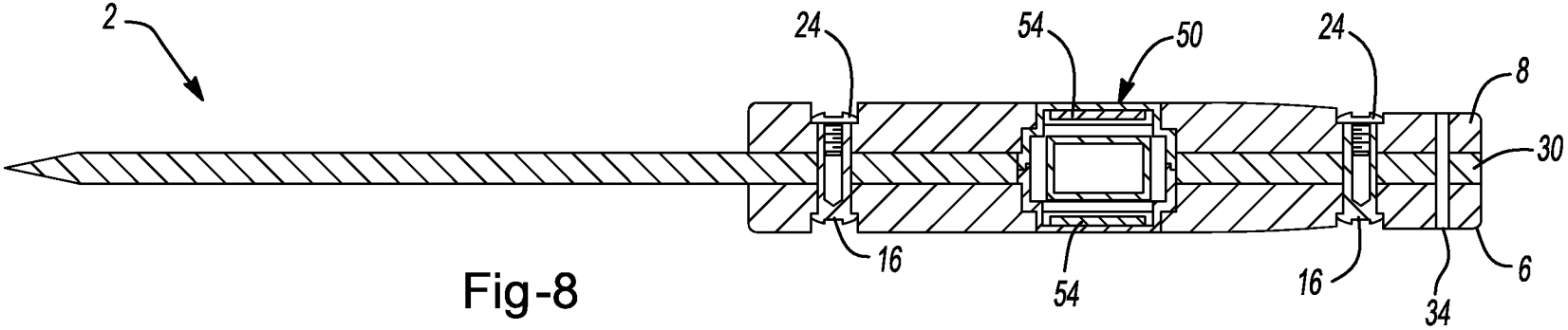
FIG. 8 shows a cross-sectional view of the module incorporated into the article of manufacture illustrated in FIG. 5 along line 8-8.

FIG. 8 shows a cross-sectional view of the module incorporated into the article of manufacture illustrated in FIG. 5 along line 8-8. As illustrated, the article of manufacture 2 includes the module 50 containing the two vials containing tritium 54. The module 50 extends through the front handle 6, the fixed knife blade 30, and the back handle 8. The two tritium vials 54 are visible on the side of the front handle 6 and on the side of the back handle 8. As illustrated, the vials containing tritium 54 are visible from the side of the front handle 6 and the side of the back handle 8. The front handle 6, the back handle 8, and the fixed knife blade 30 are attached to each other with two elongated nuts 16 and two arrow screws 24. The article of manufacture further includes an opening 34 extending through the front handle 4, the fixed knife blade 30, and the back handle 8, for attaching of the article of manufacture 2 to another object.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. A knife comprising:

a handle including a handle length extending between a proximal end and a distal end, the handle including a handle thickness extending between a first side and an opposing second side, the handle including a through-hole extending through the handle thickness and between the proximal and distal edges;

a blade connected to the handle, the through-hole extending through the blade; and a module placed into the through-hole so that an outer surface of the module is generally flush with the first side and the opposing second side of the handle, the module comprising:

one or more vials containing tritium;

a tritium holder including one or more planar surfaces, the one or more planar surfaces are located generally parallel to the first side of the handle, the second side of the handle, or both, the tritium holder including a cradle outwardly extending from one of the one or more planar surfaces, the cradle supporting opposing ends and an elongated surface of one of the one or more vials containing tritium;

pair of dome-shaped, discrete, and transparent tritium covers surrounding the tritium holder, each of the pair of tritium covers including an outer surface defining the outer surface of the module; and an open space defined between one of the one or more planar surfaces of the tritium holder and an inner surface of a corresponding one of the pair of tritium covers, the inner surface being generally parallel to the outer surface of the tritium covers and generally parallel to the planar surface, the cradle supporting the vial containing tritium being located in the open space so that the pair of tritium covers protect the vial containing tritium, and wherein the pair of tritium covers are made from a material that exhibits sufficient strength so that the module protects the one or more vials containing tritium from damage when dropped from a distance of 1 m or more, wherein an elongated portion of the one or more vials containing tritium are visible from the first side and the opposing second side of the handle.

2. The knife according to claim 1, wherein each of the pair of tritium covers have two or more of the following properties:

high transparency, wherein the light transmission is in the range of about 80% or greater in the visible light range;

high resistance to chemicals, wherein the high resistance to chemicals includes resistance towards polar media, non-polar media, or both;

high impact resistance, wherein the impact resistance is measured using Charpy impact notched, and the results are in the range of about 10 $kJ/m^2$ or greater;

high resistance to stress cracking, wherein the flexural stress is in the range of about 10 MPa or greater in polar media and non-polar media;

high heat deflection temperature, wherein the beat deflection is in the range of about −40° C. and about 82° C.; and low water absorption, wherein the water absorption is measured using a saturation point, and the results are in the range of about 3.0% or lower.

3. The knife according to claim 1, wherein each of the pair of tritium covers are made from a material with a sufficient glass transition temperature so that the tritium covers protect the one or more vials containing tritium from breaking when exposed to a temperature shock.

4. The knife according to claim 1, wherein the module has sufficient Shore D hardness so that the module is resistant to physical impact, cracking, shattering, or a combination thereof.

5. The knife according to claim 1, wherein the pair of tritium covers are attached to each other with an adhesive sealant so that the module is substantially fluid resistant.

6. The knife according to claim 1, wherein the pair of tritium covers are bonded to the tritium holder forming the module, and the module is sufficiently secure so that the one or more tritium vials within the pair of tritium covers are protected from fluid penetration, physical impact, cracking, shattering, chemicals, temperature shock, or a combination thereof.

7. The knife according to claim 1, wherein the tritium holder includes one or more grooves to improve the bonding between the tritium holder and the pair of tritium covers.

8. The knife according to claim 1, wherein the one or more vials containing tritium are bonded to the one or more cradles so that the one or more vials containing tritium are prevented from shifting vertically, horizontally, diagonally, rotationally, or a combination thereof during impact.

9. The knife according to claim 1, wherein the module further comprises voids, holes, through-holes, recesses, or a combination, thereof, so that the module may be attached to the knife;

the handle including a handle length extending between a proximal end and a distal end, the handle including a handle thickness extending between a first side and an opposing second side, the handle including a through-hole extending through the handle thickness and between the proximal and distal edges.

10. An article of manufacture comprising:

a handle including a handle length extending between a proximal end and a distal end, the handle including a handle thickness extending between a first side and an opposing second side, the handle including a hole extending between the proximal end and the distal end, the hole also extending through the first side, the opposing second side, and a top side of the handle;

a module placed into the hole so that a first outer side surface of the module is generally flush with the first side, a second outer side surface of the module is generally flush with the opposing second side of the handle, and an outer top surface of the module is generally flush with the top side of the handle, the module comprising:

one or more vials containing tritium;

a tritium holder including a planar surface and one or more cradles extending outwardly from the planar surface, each cradle supporting opposing ends and an elongated surface of one vial containing tritium;

a transparent dome-shaped tritium cover engaging at least a portion of the planar surface of the tritium holder, the tritium cover including an outer surface defining the outer top surface of the module; and an open space defined between the planar surface and an inner surface of the tritium cover, the inner surface being opposite the outer surface of the tritium cover, the one or more cradles and the one or more vials containing tritium are located in the open space, wherein the one or more vials containing tritium are located within the open space so that the tritium cover protects the one or more vials containing tritium, and wherein the tritium cover is made from a material that exhibits sufficient strength so that the module protects the one or more vials containing tritium from breaking when dropped from a distance of 1 m or more;

wherein an elongated portion of the one or more vials containing tritium are visible from the first side, the opposing second side, and the top side of the handle.

11. An article of manufacture according to claim 10, wherein the article of manufacture is a knife having a folding blade, a tool, a flashlight, a utensil, a shovel, a screwdriver, a hammer, an ice ax, a gripping portion of a tool, or a combination thereof.

12. An article of manufacture according to claim 10, wherein the tritium cover has two or more of the following properties:

high transparency, wherein the light transmission is in the range of about 80% or greater in the visible tight range;

high resistance to chemicals, wherein the high resistance to chemicals includes resistance towards polar media, non-polar media, or both;

high impact resistance, wherein the impact resistance is measured using Charpy impact notched, and the results are in the range of about 10 $kJ/m^2$ or greater;

high resistance to stress cracking, wherein the flexural stress is in the range of about 10 MPa a or greater in polar media and non-polar media;

high heat deflection temperature, wherein the heat deflection is in the range of about −40° C. and about 82° C.; and low water absorption, wherein the water absorption is measured using a saturation point, and the results are in the range of about 3.0% or lower.

13. A method comprising:

providing an instrument including a handle including a handle length extending between a proximal end and a distal end, the handle including a handle thickness including a first side and an opposing second side, and a through-hole extending through the first side to the opposing second side and between the proximal and distal edges;

providing a first tritium vial and a second tritium vial;

injection molding a first transparent tritium cover and a second transparent tritium cover, each tritium cover having a dome shape and including an outer surface and an opposing inner surface;

injection molding a tritium holder having a first planar surface and a first cradle extending from the first planar surface, and a second planar surface and a second cradle extending from the second planar surface, wherein the first planar surface and the second planar surface are generally parallel to one another, bonding the first tritium vial to the first cradle and the second tritium vial to the second cradle;

positioning the tritium holder between the first tritium cover and the second tritium cover, bonding the first tritium cover to the second tritium cover so that the first tritium vial is located within an open space defined between the first planar surface and the inner surface of the first tritium cover, and the second tritium vial is located within an open space defined between the second planar surface and the inner surface of the second tritium cover; and inserting the bonded first and second tritium covers into the through-hole so that a shoulder of the first tritium cover engages a corresponding shoulder in the handle, and a shoulder of the second tritium cover engages a corresponding shoulder in the handle, and wherein after inserting the bonded first and second tritium covers into the through-hole, an elongated portion of the first tritium vial is visible from the first side and an elongated portion of the second tritium vial is visible from the second side.

14. The method of claim 13, wherein the method includes the steps of:

bonding the first tritium vial to the first cradle with an adhesive sealant and the second tritium vial to the second cradle with the adhesive sealant; and inserting the bonded first and second tritium covers and tritium holder into the through-hole so that an outer surface of the first tritium cover is generally flush with the first side and an outer surface of the second tritium cover is flush with the opposing second side of the handle.

15. The method of claim 14, wherein the method includes a step of pretreating a surface of the tritium holder, the first tritium cover, the second tritium cover, the first tritium vial, the second tritium vial, or a combination thereof, with a primer or corona treatment.

16. The knife according to claim 1, wherein the one or more planar surfaces comprise a first planer surface and a second planar surface that is generally parallel to the first planar surface, the first planar surface includes a first cradle of the at least one cradle, and the second planar surface includes a second cradle of the at least one cradle, the first cradle supporting opposing ends of a first vial containing tritium, and the second cradle supporting opposing ends of the second vial containing tritium.

* * * * *